US007404556B2

(12) United States Patent
Allen, Jr. et al.

(10) Patent No.: US 7,404,556 B2
(45) Date of Patent: Jul. 29, 2008

(54) AUTOMATIC ANGLE ADJUSTMENT MECHANISM FOR STACKING APPARATUS

(75) Inventors: Clarence C. Allen, Jr., Mt. Crawford, VA (US); Walter R. Dent, Harrisonburg, VA (US); Joseph W. Bush, Jr., Grottoes, VA (US); Sharon L. Myers, Weyers Cave, VA (US)

(73) Assignee: A. G. Stacker, Inc., Wyers Cave, VA (US)

( * ) Notice: Subject to any disclaimer, the term of this patent is extended or adjusted under 35 U.S.C. 154(b) by 303 days.

(21) Appl. No.: 11/117,653

(22) Filed: Apr. 29, 2005

(65) Prior Publication Data

US 2006/0244205 A1 Nov. 2, 2006

(51) Int. Cl.
*B65H 29/50* (2006.01)

(52) U.S. Cl. ..... 271/201; 198/836.1

(58) Field of Classification Search ..... 271/201, 271/200, 198; 198/836.1; 414/790, 790.1
See application file for complete search history.

(56) References Cited

U.S. PATENT DOCUMENTS 2,642,221 A * 6/1953 Offutt et al. ..... 254/35
2,660,432 A * 11/1953 Wilske et al. ..... 271/201
2,901,250 A * 8/1959 Martin ..... 271/201
3,142,388 A 7/1964 Cole
3,321,202 A * 5/1967 Martin ..... 271/199
3,393,908 A * 7/1968 Griffin ..... 271/199
3,419,266 A * 12/1968 Martin ..... 271/189
3,549,144 A * 12/1970 Lucas ..... 271/201
3,593,860 A * 7/1971 Brenner ..... 414/793.5
3,613,910 A * 10/1971 Weir ..... 414/281
3,658,322 A 4/1972 Martin
3,674,256 A 7/1972 Brookhyser
3,704,882 A 12/1972 Brookhyser
3,715,043 A * 2/1973 Weir ..... 414/390
3,717,263 A * 2/1973 McWilliams ..... 414/789.8
3,724,840 A 4/1973 Kuckhermann
3,727,911 A 4/1973 Vits
3,752,298 A * 8/1973 Wenger ..... 198/816
3,779,404 A * 12/1973 McWilliams ..... 414/344
3,791,269 A 2/1974 Sawada
3,819,068 A * 6/1974 Weir ..... 414/787

(Continued)

*Primary Examiner*—Patrick Mackey
*Assistant Examiner*—Michael C McCullough
(74) *Attorney, Agent, or Firm*—Jefferson IP Law, LLP

(57) ABSTRACT

A device for stacking sheets includes a layboy, a transfer conveyor, a main conveyor, a diverting apparatus, and an accumulator. The main conveyor is pivotably mounted to a base to that it may be pivoted between an upper position and a lower position. The diverting apparatus has a plurality of diverting slats pivotably mounted to a support shaft so that the slats may be raised and lowered. When the main conveyor is in the upper position, the diverting slats are not activated, that is, they are not raised. Accordingly, when sheets are transferred along and discharged from the main conveyor, the trajectory of the sheets is basically the same as the angle of the conveyor. In contrast, when the main conveyor is in a lower position, the slats are raised. Accordingly, discharged sheets are diverted so that the trajectory of the sheets is different than the angle of the conveyor. The slats may be placed at any chosen angle. By adjusting the angle of discharge of sheets with respect to the main conveyor, interlock jamming is minimized in the accumulator. The sheet stacking device, including the diverting apparatus, is controlled by a programmable logic controller interfaced with a touch screen.

30 Claims, 16 Drawing Sheets

U.S. PATENT DOCUMENTS

| | | | | | |
|---|---|---|---|---|---|
| 3,853,230 | A | * | 12/1974 | Schultz | 414/564 |
| 3,880,420 | A | | 4/1975 | Martin | |
| 3,885,682 | A | * | 5/1975 | McWilliams | 414/789.8 |
| 3,904,024 | A | * | 9/1975 | Smith | 414/788.7 |
| 3,938,674 | A | | 2/1976 | Kroeze et al. | |
| 3,964,588 | A | | 6/1976 | Kornylak | |
| 3,992,001 | A | | 11/1976 | Martin | |
| 4,084,809 | A | | 4/1978 | Looney | |
| 4,099,712 | A | | 7/1978 | Martin | |
| 4,169,586 | A | | 10/1979 | Tarosky et al. | |
| 4,268,028 | A | | 5/1981 | Martin | |
| 4,279,555 | A | * | 7/1981 | Rydell | 414/793.8 |
| 4,283,185 | A | | 8/1981 | Woolston et al. | |
| 4,620,629 | A | * | 11/1986 | Dean | 198/836.1 |
| 4,768,912 | A | | 9/1988 | Miura | |
| 4,884,677 | A | | 12/1989 | Yu et al. | |
| 4,958,827 | A | | 9/1990 | Kaneko | |
| 5,088,873 | A | * | 2/1992 | Ruder et al. | 414/392 |
| 5,568,857 | A | * | 10/1996 | Chen et al. | 198/592 |
| 5,697,753 | A | * | 12/1997 | Aurora et al. | 414/398 |
| 6,006,893 | A | * | 12/1999 | Gilmore et al. | 198/588 |
| 6,234,473 | B1 | | 5/2001 | Morgan et al. | |
| 6,431,346 | B1 | * | 8/2002 | Gilmore et al. | 198/588 |
| 6,471,461 | B2 | * | 10/2002 | Muilwyk | 414/276 |
| 6,484,862 | B1 | * | 11/2002 | Gilmore et al. | 193/35 TE |
| 6,533,096 | B2 | * | 3/2003 | Gilmore et al. | 193/35 TE |
| 6,666,450 | B2 | | 12/2003 | Slocum et al. | |
| 6,814,216 | B2 | | 11/2004 | Veit et al. | |
| 6,823,985 | B2 | * | 11/2004 | Gilmore et al. | 198/588 |
| 6,986,635 | B2 | * | 1/2006 | Talken et al. | 414/790 |
| 7,077,615 | B2 | * | 7/2006 | Thogersen et al. | 414/346 |
| 7,104,747 | B2 | * | 9/2006 | Talken et al. | 414/790 |
| 2004/0094890 | A1 | * | 5/2004 | Chiasson et al. | 271/205 |

* cited by examiner

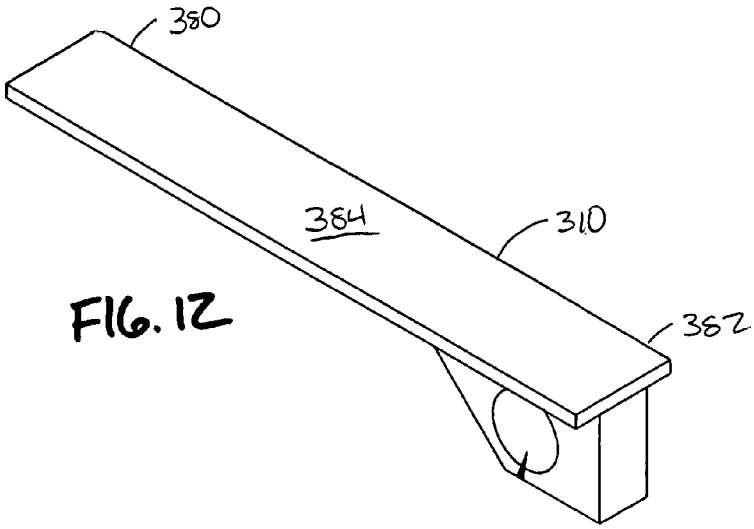
FIG. 12
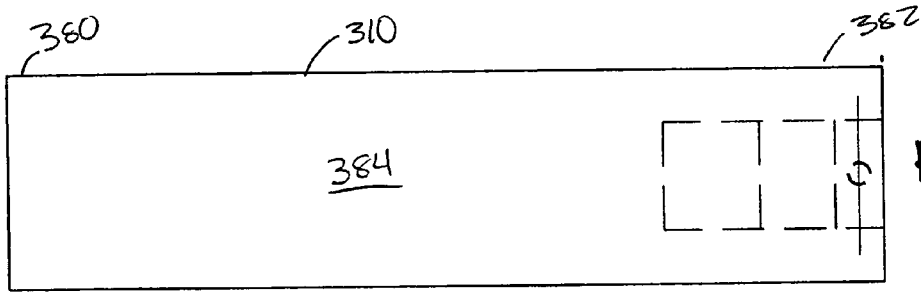
FIG. 13
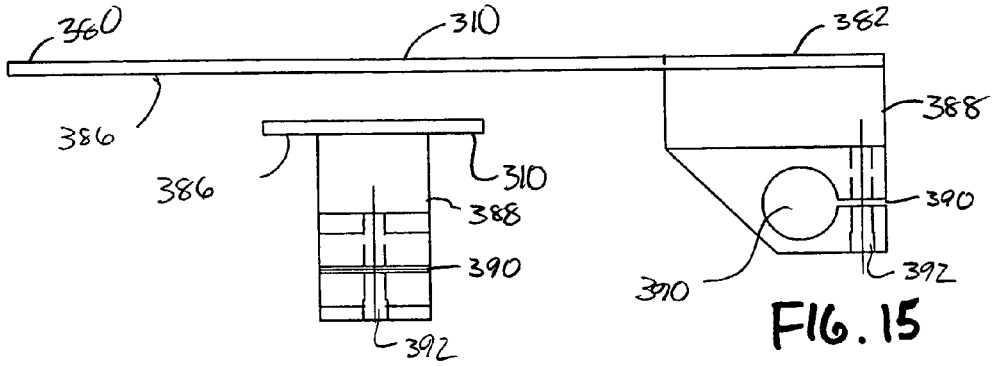
FIG. 15
FIG. 14

TOUCH SCREEN

Window 21

TOUCH SCREEN

Window 19

AUTOMATIC ANGLE ADJUSTMENT MECHANISM FOR STACKING APPARATUS

FIELD OF THE INVENTION

The present invention generally relates to an apparatus for stacking sheets of material. More specifically, the present invention relates to an apparatus for changing the angle of discharge of a conveyor for stacking sheets of corrugated material.

BACKGROUND OF THE INVENTION

Devices for stacking sheets of material, such as sheets of corrugated material, are well known. One example of a commercially available device is the AGS2000 Rotary Die Cut Stacker made by the assignee of the present invention, A.G. Machine, Inc., Weyers Cave, Va. Further examples of such devices are disclosed in U.S. Pat. No. 3,321,202 to Martin and U.S. Pat. No. 3,419,266 to Martin, each of which is expressly incorporated by reference in its entirety.

FIGS. 1 and 2 illustrate a conventional apparatus for stacking corrugated blanks. As seen there, the stacking machine 100 generally comprises a layboy section 102 which receives corrugated blanks, such as those produced by a rotary die cut machine (not illustrated), and discharges the corrugated blanks onto a transfer conveyor 104. The transfer conveyor 104 receives the blanks and transports them to a main conveyor 106. The main conveyor 106 has an intake end 108 and a discharge end 110. At its intake end 108, the main conveyor 106 is mounted to a base 112 at a pivot point 114 so that the conveyor may be pivoted to raise the discharge end 110 of the conveyor 106. At the discharge end 110 of the conveyor 106, an accumulator section 116 receives discharged blanks.

In operation, the main conveyor 106 is pivoted about the pivot point to lower the discharge end 110 of the conveyor to an initial position. (The illustrated position illustrates the conveyor raised to an upper position.) Sheets are fed onto the main conveyor 106 at its intake end 108, transported along the distance of the conveyor to its discharge end 110, and discharged from the conveyor. The sheets are discharged with sufficient momentum to strike a backstop 118 in the accumulator section 116 that stops the forward momentum of the sheets. The stopped sheets settle down, typically onto a discharge conveyor, to form a stack of sheets. As additional sheets are placed on the stack, the main conveyor 106 is pivoted to raise the discharge end vertically so that the discharged sheets are stacked one by one.

Once a stack of sheets is completed, to permit time to carry the stack of sheets away without stopping the machine, the accumulator section 116 is activated by activating catcher elements 120. The catcher elements 120 hold sheets in the accumulator section while the previously formed stack is removed. After the stack is removed, the main conveyor 106 is lowered and the accumulator section 116 is deactivated by withdrawing the catcher elements 120. The accumulated sheets are dropped to form a new stack of sheets.

One drawback to conventional stackers such as this is that the discharged sheets sometimes become interlocked and jammed in the accumulator. This occurs partially because the angle of discharge of the conveyor varies. When the main conveyor is placed at the position shown in FIG. 1, that is, an upper position, the conveyor has an angle $\theta_1$ with respect to horizontal. Sheets are discharged from the conveyor at the same angle as the angle of the conveyor, and, therefore, in the upper position, sheets are discharged with some upward momentum. On the other hand, when the main conveyor is lowered to the initial position described above, the angle $\theta_1$ is 0°, or even negative, with the conveyor 106 angled down with respect to horizontal. Discharged sheets therefore have either no upward momentum, or may even have downward momentum. This variation in the momentum of discharged sheets affects the seating of sheets into the accumulator section.

There have been attempts to address this issue, and one common method is the use of forced air. Forced air is blown underneath a discharged sheet to form a cushion so that discharged sheets settle more uniformly. Forced air has proven to be useful, yet it also has drawbacks. The forced air can vary in intensity and location, thereby preventing blanks from being adequately diverted. Furthermore, the trajectory and force of the air is not always sufficient to assure that sheets are properly seated into the accumulator.

Accordingly, there is a need for an improved apparatus for stacking sheets that guides corrugated blanks into an accumulator in a manner that minimizes, or prevents, interlock jamming in the accumulator.

SUMMARY OF THE INVENTION

An object of the present invention is to solve at least the above problems and/or disadvantages and to provide at least the advantages described below. Accordingly, an object of the present invention is to provide a conveyor with a discharge mechanism for guiding and seating blanks in an accumulator.

In accordance with an object of the invention, an apparatus for stacking sheets includes a base and a conveyor pivotably mounted to the base. The conveyor receives sheets at an intake end, transports the sheets, and discharging the sheets from a discharge end. A plurality of pivotable slats are located at the discharge end of the conveyor. The pivotable slats can be raised and lowered to adjust the angle of discharge of discharged sheets.

In accordance with another object of the invention, a conveyor for a device for stacking sheets has a conveyor frame with an intake end and a discharge end. A conveyor is disposed on the conveyor frame for receiving sheets at the intake end, transporting the sheets, and discharging the sheets from the discharge end. A plurality of pivotable slats are located at the discharge end of the conveyor for adjusting the angle of discharge of discharged sheets. An accumulator receives sheets discharged from the discharge end of the conveyor to form a uniform stack of sheets.

In accordance with yet another object of the invention, an apparatus for adjusting the angle of discharge of sheets being discharged from a discharge end of a conveyor in a sheet stacking device has shaft support members located at the discharge end of the conveyor. A support shaft is rotatably disposed in the shaft support members. A plurality of slats are provided with each slat having a first end and a second end. The second end of each slat is connected to the support shaft. An actuator is connected to the support shaft to rotate the support shaft.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure:

FIG. 12 is a perspective of a slat of an embodiment of the present invention;

FIG. 13 is a top plan view of the slat shown in FIG. 12;

FIG. 14 is a right elevational view of the slat shown in FIG. 12;

FIG. 15 is a front elevational view of the slat shown in FIG. 12;

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
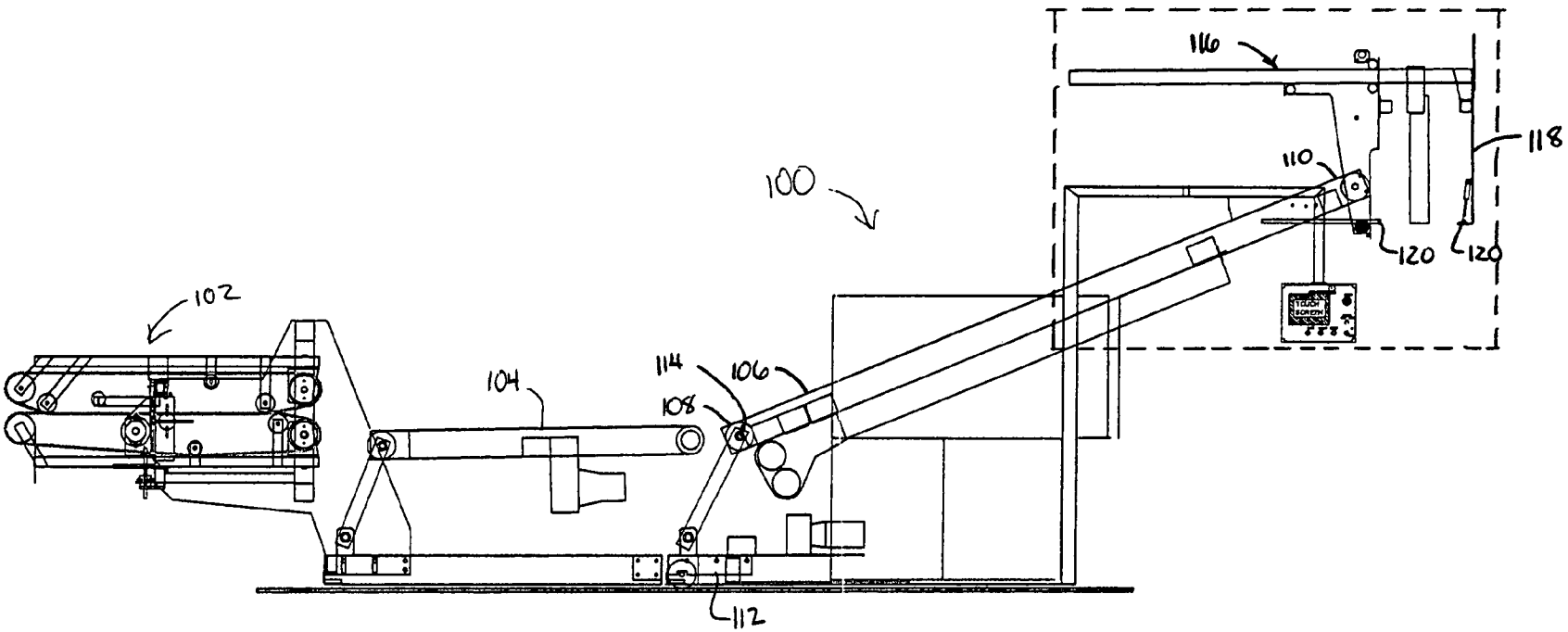
FIG. 1 PRIOR ART
FIG. 1 is a front elevational view of a conventional stacking machine.
Figure 2:
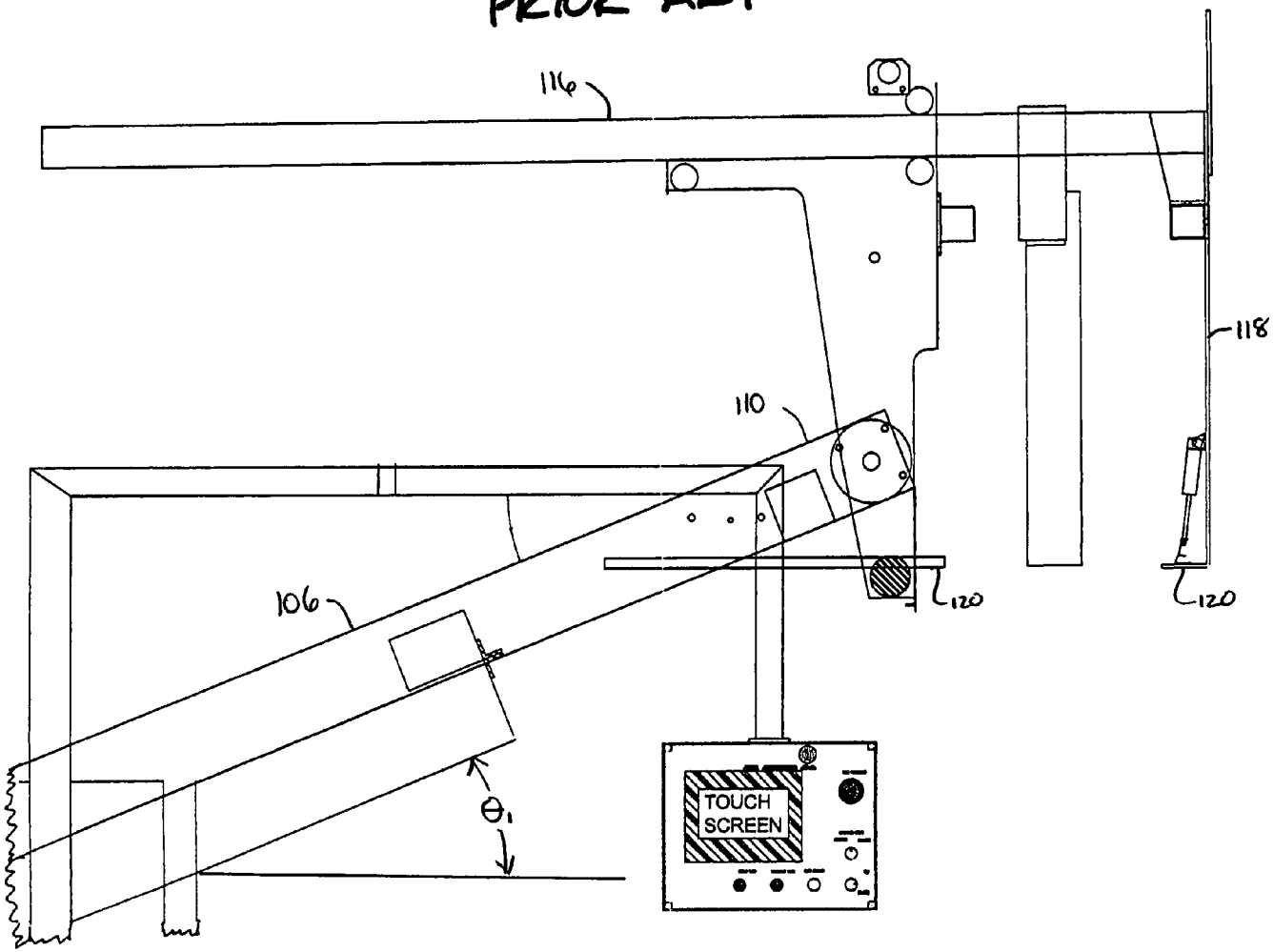
FIG. 2 PRIOR ART
FIG. 2 is an enlarged view of the portion FIG. 1 indicated with dashed lines.
Figure 3:
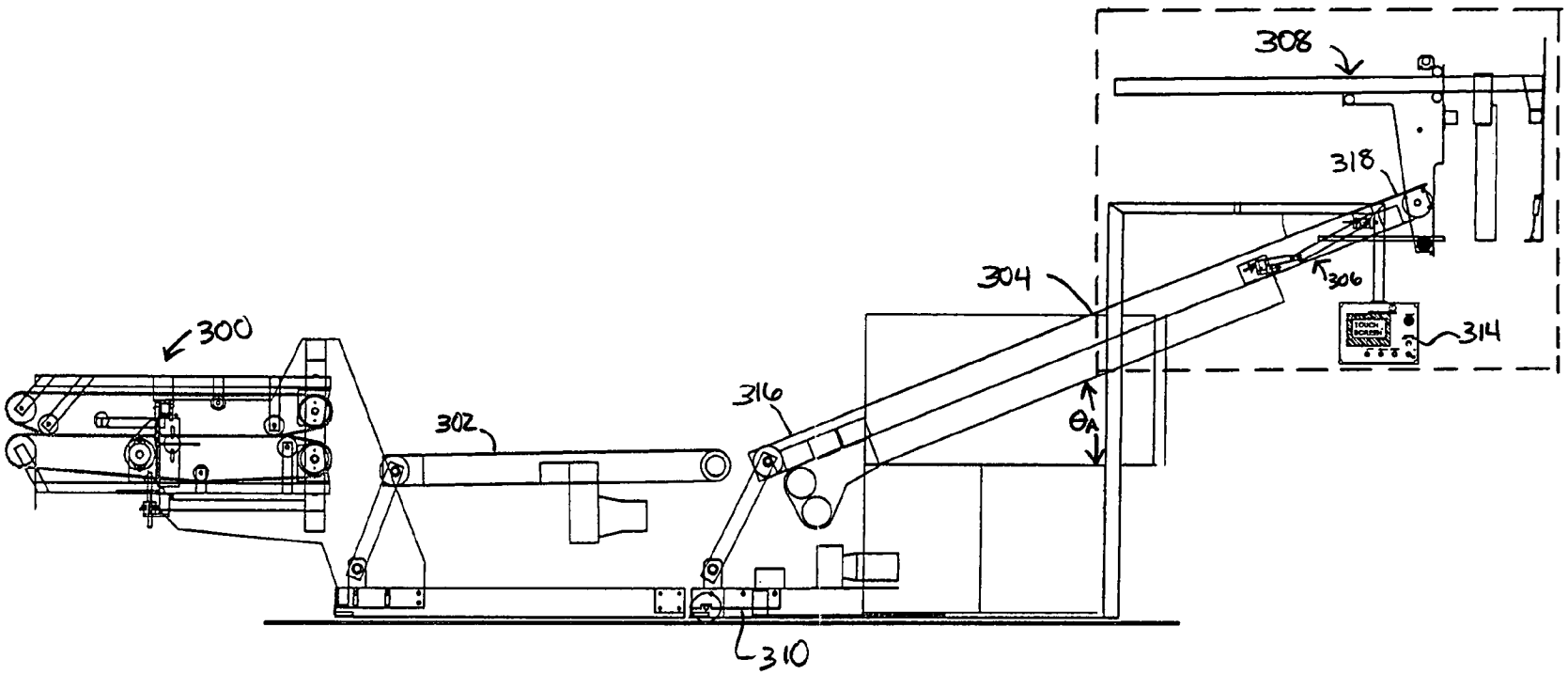
FIG. 3 is a front elevational view of a stacking machine in accordance with an embodiment of the invention.
Figure 4:
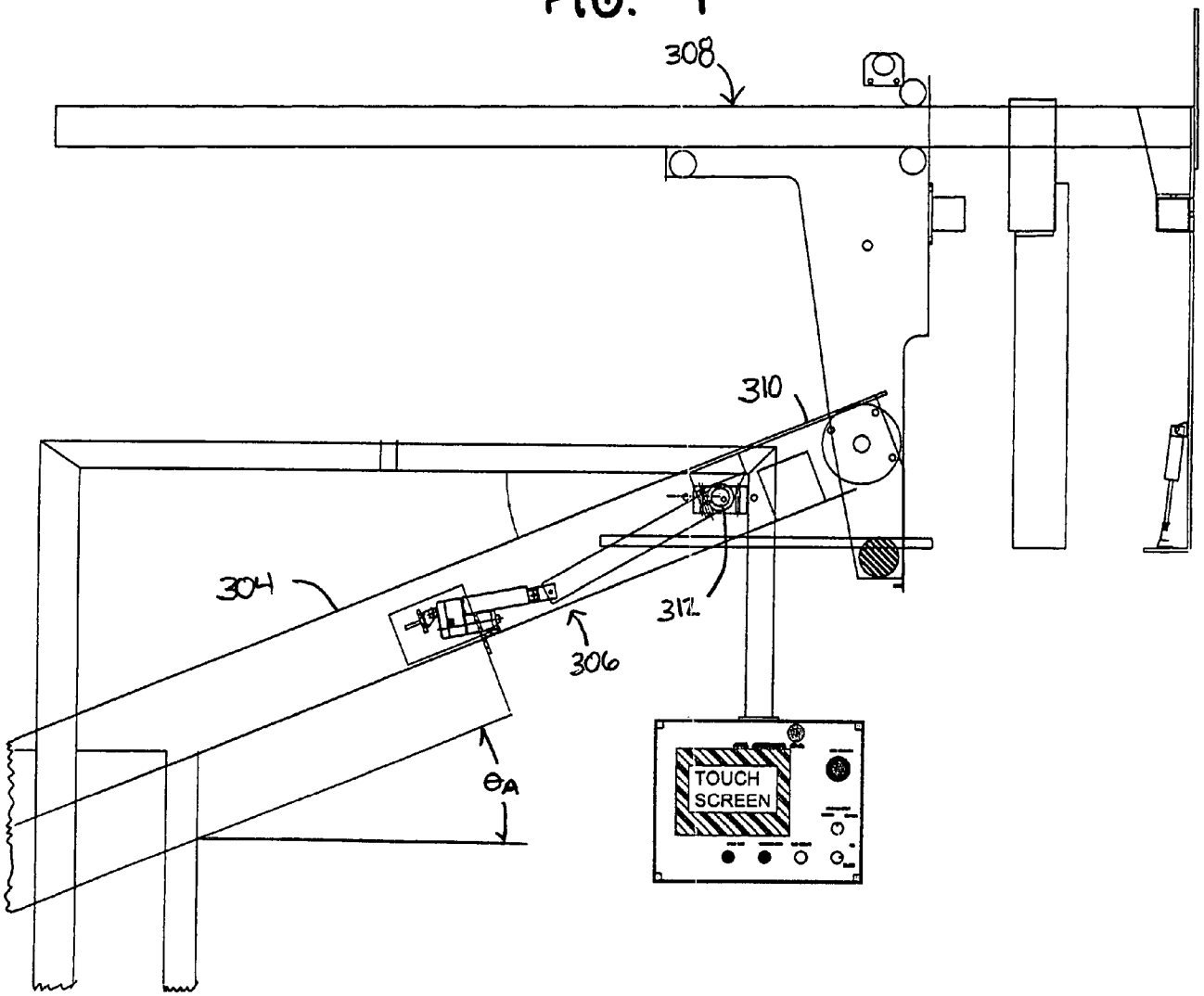
FIG. 4 is an enlarged view of the portion FIG. 3 indicated with dashed lines.
Figure 5:
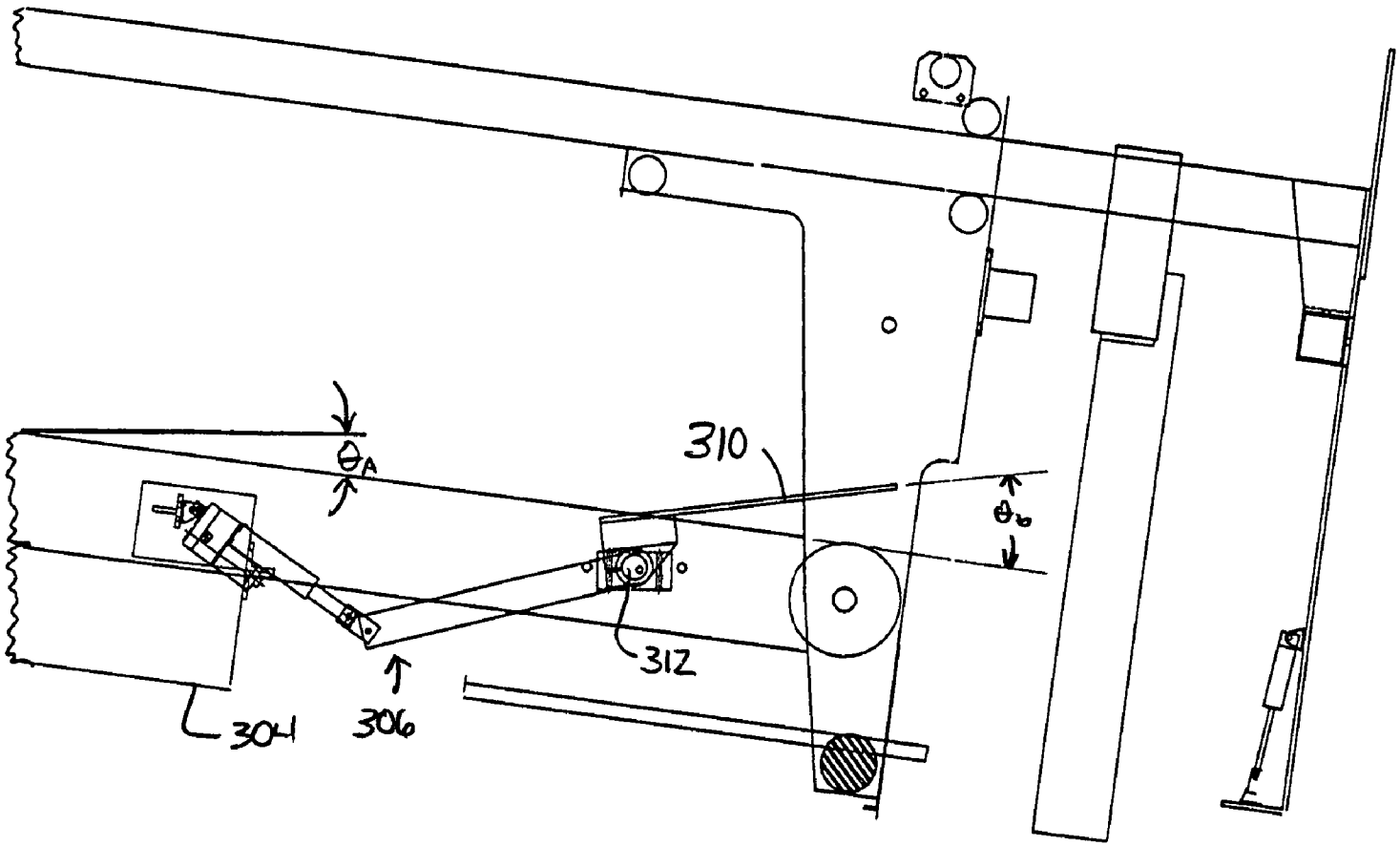
FIG. 5 is a front elevational view of the accumulator section illustrated in FIG. 3, with the conveyor in a lowered position.

Referring initially to FIGS. 3 and 4, a device for stacking sheets in accordance with an embodiment of the present invention includes a layboy section 300, a transfer conveyor 302, a main conveyor 304, a diverting apparatus 306, and an accumulator section 308. The main conveyor 304 is pivotably mounted to a base 310 to that it may be pivoted between an upper position and a lower position. The diverting apparatus 306 has a plurality of diverting slats 310 pivotably mounted to a support shaft 312 so that the diverting slats 310 may be raised and lowered. The main conveyor is positioned at an angle $\theta_a$ (measured counterclockwise from a horizontal axis). When the main conveyor 304 is in the upper position, $\theta_a$ is equal to an angle $\theta_{max}$, which is dependent on the particular configuration of the stacking machine. In the upper position, the diverting slats 310 are not activated, that is, they are not raised. Accordingly, when sheets are transferred along and discharged from the main conveyor 304, the trajectory of the sheets is basically the same as the angle $\theta_{a(max)}$. In contrast, as shown in FIG. 5, when the main conveyor 304 is in a lower position, the angle $\theta_a$ is equal to an angle $\theta_{a(min)}$. At $\theta_{a(min)}$, the diverting apparatus 306 is activated to raise the diverting slats 310, that is, they are raised to an angle $\theta_b$ (measured counterclockwise with respect to the main conveyor). Accordingly, discharged sheets are diverted so that the trajectory of the sheets is different than the angle $\theta_a$ of the conveyor. Thus, the diverting apparatus 306 provides the ability to vary the angle of discharge of the conveyor. By varying the angle of discharge, the discharged sheets can be more precisely delivered to the accumulator section 308 so that they seat properly in the accumulator section 308. Preferably, the sheet stacking apparatus, including the diverting apparatus, is controlled by a programmable logic controller 314 that includes a touchscreen for operator entry.

Figure 6:
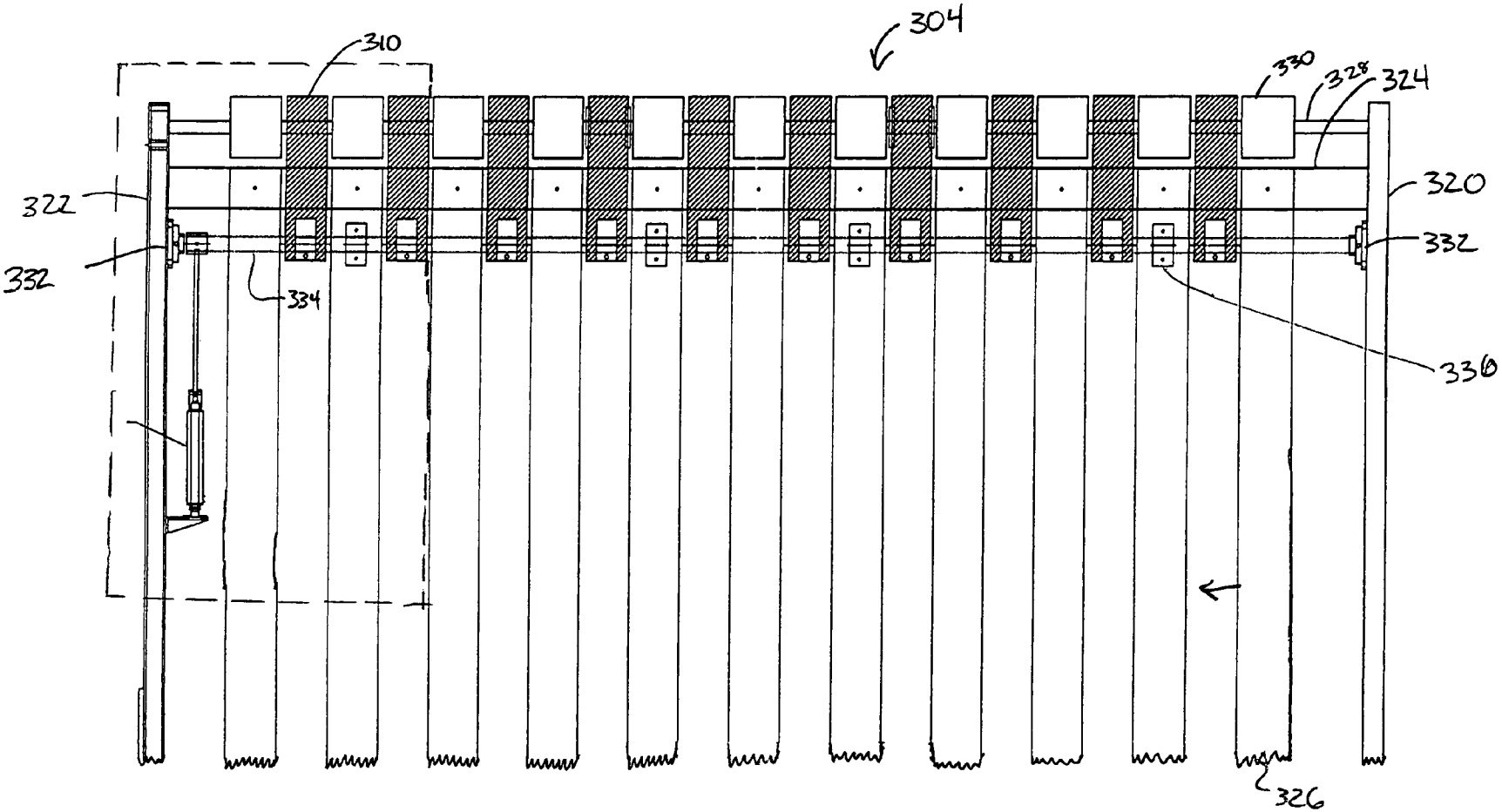
FIG. 6 is a top plan view of the end of the main conveyor of the stacking machine of FIG. 3.
Figure 7:
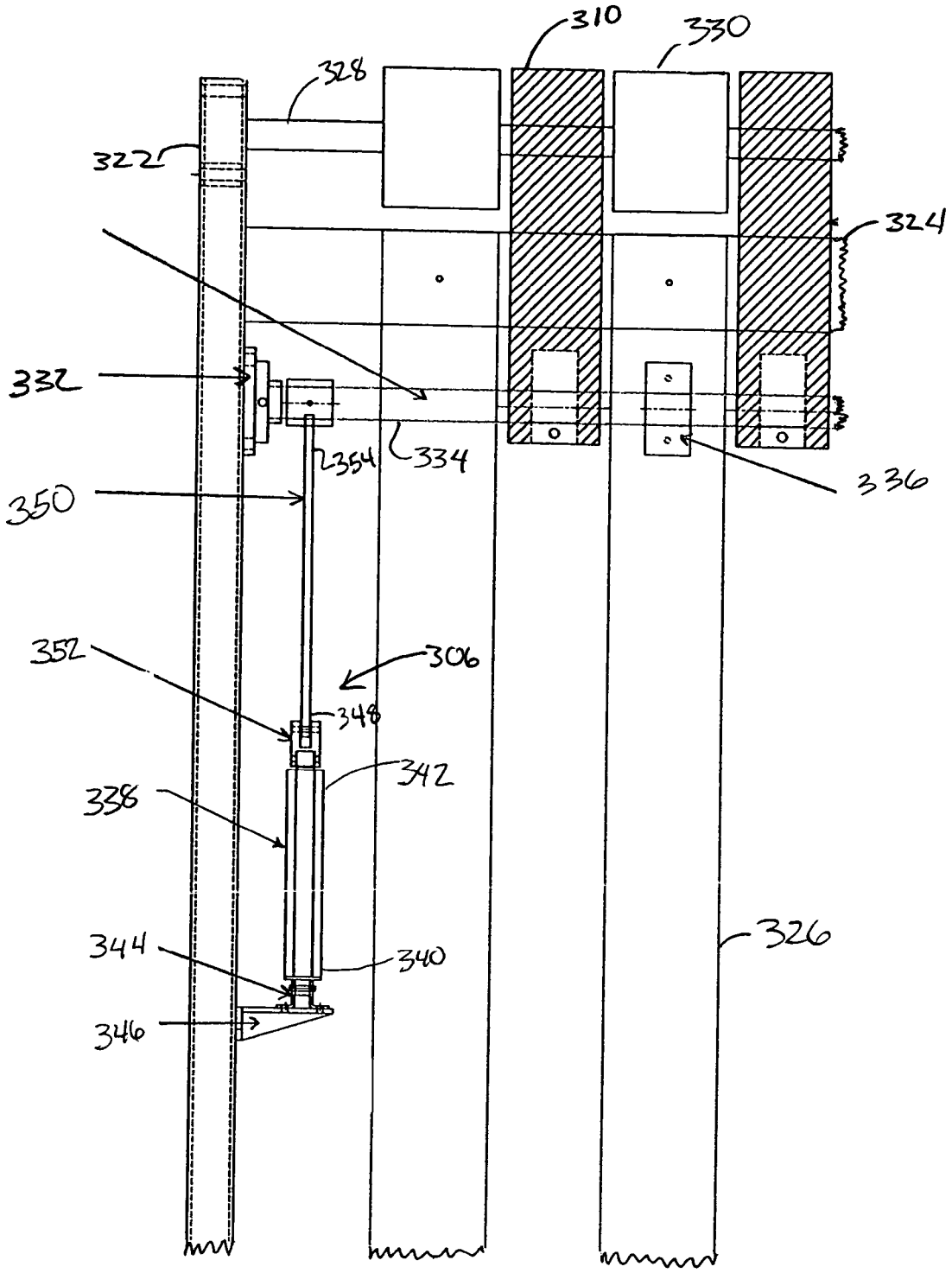
FIG. 7 is an enlarged view of the portion of FIG. 6 indicated with dashed lines.

The main conveyor 304 has an intake end 316 and a discharge end 318. FIGS. 6 and 7 show the discharge end 318 of the main conveyor 304. The main conveyor 304 has a right frame member 320 and a left frame member 322. A cross member 324 connects the right and left frame members 320 and 322. A plurality of deck tubes 326 extend along the length of the conveyor. Preferably, the deck tubes are made of aluminum. A roller shaft 328 holds a plurality of rollers 330. The rollers support conveyor belts, which are not illustrated here for clarity. The position, or angle $\theta_a$, of the main conveyor is detected by a main conveyor sensor (not illustrated). Preferably, the sensor is a potentiometer that supplies a 0 to 10 VDC signal to the PLC 314.

A pair of bearings 332 are mounted on the right and left frame members 320 and 322 to hold a support shaft 334 so that it may rotate. A plurality of support brackets 336 are mounted on the underside of the deck tubes 326 to provide additional support for the support shaft 334. A plurality of diverting slats 310 are mounted on the support shaft 334.

Figure 8:
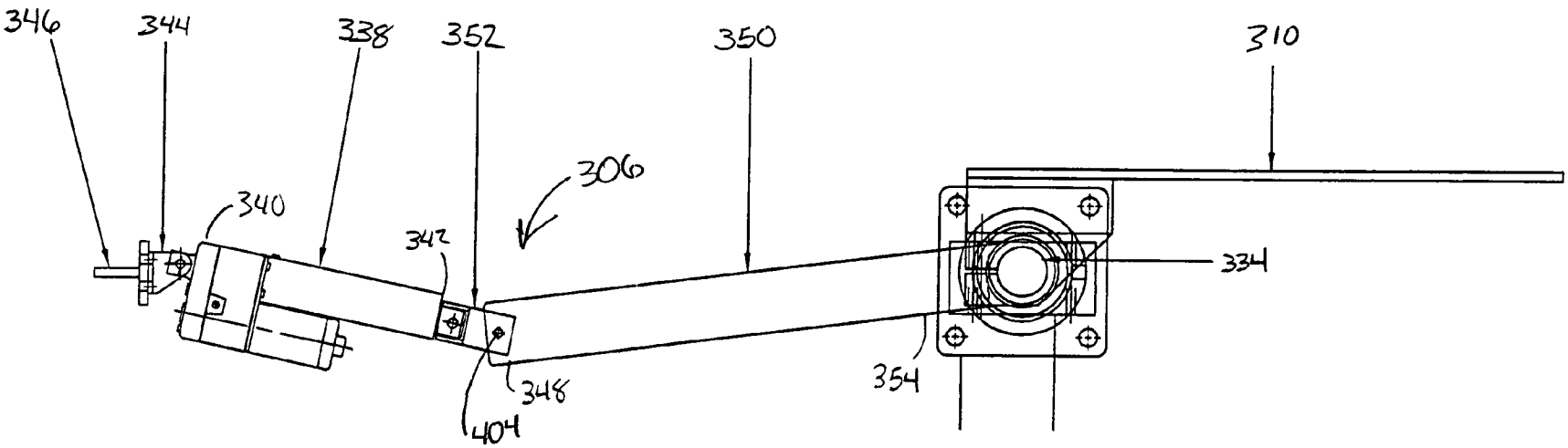
FIG. 8 is a front elevational view of the diverting assembly of the present invention.

As seen most clearly in FIGS. 7 and 8, the diverting apparatus 306 includes a linear actuator 338 with a first end 340 and a second end 342. The first end 340 of the linear actuator 338 is fastened to the left frame member 322 by a first pivot bracket 344 which is mounted to an angle bracket 346 mounted on the left frame member 322. The second end 342 of the actuator 338 is attached to the first end 348 of a lever arm 350 by a second pivot bracket 352. The second end 354 of the lever arm 350 is fastened to the support shaft 334. Thus, when the actuating shaft of the linear actuator 338 is extended, the actuator forces the first end 348 of the lever arm 350 down, and thereby rotates the support shaft 334 and the diverting slats 310 mounted on the support shaft 334. Preferably, the diverting apparatus is arranged so that a 1" extension of the actuator produces a seven (7) degree angle $\theta_b$.

Figure 9:
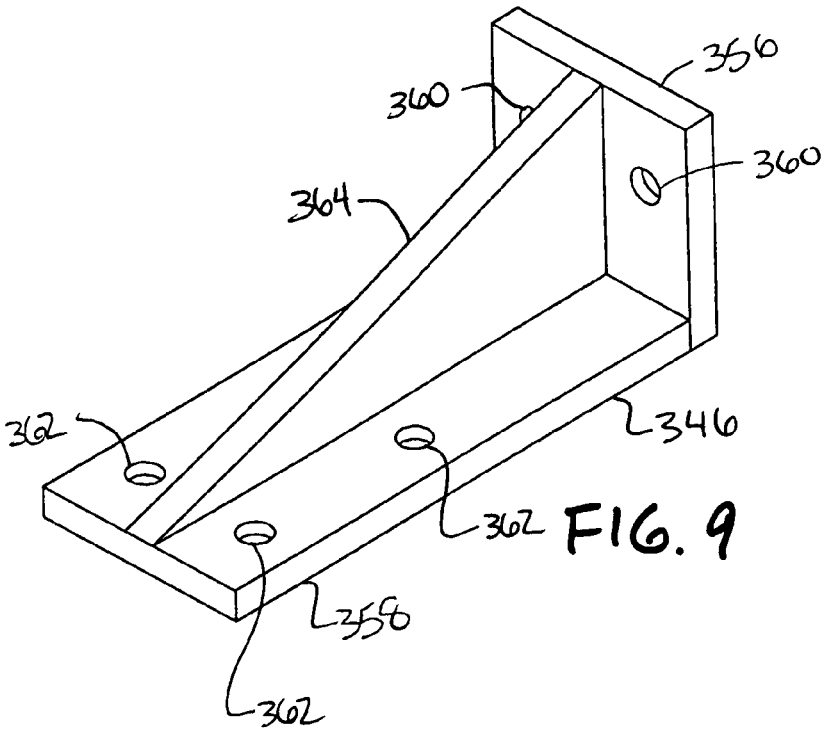
FIG. 9 is a perspective view of an angle bracket.

FIG. 9 is a perspective view of the angle bracket 346. The angle bracket has a first arm 356 and a second arm 358. The first arm 356 has two through holes 360 so that it may be attached to the left frame member 322 by mechanical fasteners such as bolts. The second arm, which is preferably at a right angle to the first arm, has four through holes 362. A strengthening member 364 provides additional strength to the angle bracket 346. Preferably, the angle bracket is made of welded steel.

Figure 10:
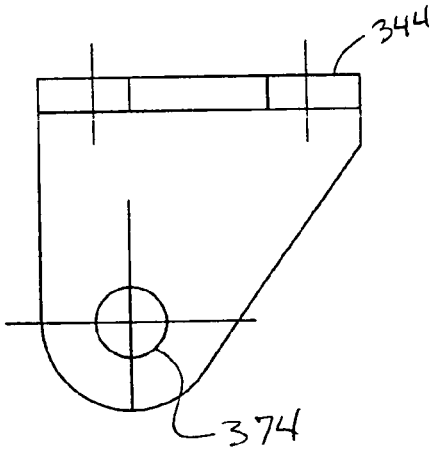
FIG. 10 is a side elevational view of a pivot bracket.
Figure 11:
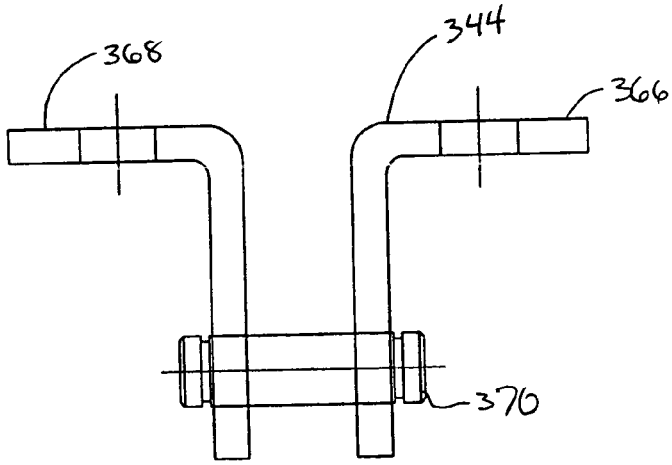
FIG. 11 is a right elevational view of the pivot bracket shown in FIG. 10.

FIGS. 10 and 11 illustrate the first pivot bracket 344. The first pivot bracket 344 has a right support member 366, a left support member 368, and a pivot pin 370. The right and left support members 366 and 368 both have two through holes 372 so that they may be attached to the angle bracket 346 by mechanical fasteners such as bolts. The pivot pin 370 extends through pivot pin holes 374 located in the right and left support members 366 and 368. The right and left support member 366 and 368 are spaced apart from one at a sufficient distance to receive the first end 376 of the actuator 338. Preferably, the first pivot bracket is made of steel.

FIGS. 12-15 illustrate a diverting slat 310. A diverting slat 310 has a first end 380, a second end 382, a top surface 384, and a bottom surface 386. The diverting slat 310 is preferably formed of aluminum, and the top surface 384 of the diverting slat 310 is covered with adhesive backed UHMW (ultra-high molecular weight) polyethylene so that the slats do not snag sheets passing over the slats. A mounting bracket 388 is formed on the bottom surface 386 of the second end 382 of the diverting slat 310. The mounting bracket 388 includes a hole 390 so that it may be placed onto the support shaft 334. The mounting bracket 388 has a gap 390 that allows the bracket to be clamped onto the support shaft 334. A bolt hole 392 receives a bolt (not illustrated) to apply a clamping force. Preferably, the mounting bracket is integrally formed with the diverting slat.

The support shaft 334 is preferably 1144 cold-rolled steel. In the embodiment illustrated here, the support shaft 334 has an outside diameter of approximately 1⅜".

Figure 16:
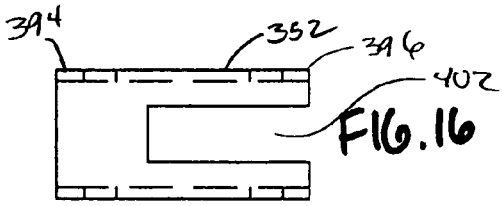
FIG. 16 is a top plan view of a connector of an embodiment of the present invention.
Figure 18:
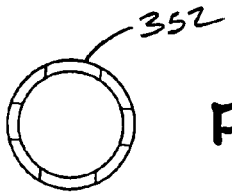
FIG. 18 is a right side elevational view of the connector shown in FIG. 16.
Figure 17:
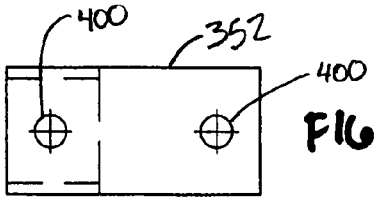
FIG. 17 is a front elevational view of the connector shown in FIG. 16.

FIGS. 16-18 illustrate a second pivot bracket 352. The second pivot bracket 352 is cylindrical and hollow with a first end 394 and a second end 396. The first end 394 of the second pivot bracket 352 is sized to receive an actuating shaft 398 (FIG. 22) of the linear actuator 338. Through holes 400 allow the second pivot bracket 352 to be firmly fastened to the actuator shaft 398 by a bolt or any other suitable mechanical fastener. The second end 396 of the second pivot bracket 352 has an opening 402 to receive a first end 348 of the lever arm 350. A pivot pin may be placed through the through holes 400 in the second end 396 of the second pivot bracket 352. The opening 402 and the pivot pin 404 (FIG. 8) allow the lever arm 350 to pivot with respect to the second pivot bracket 352. Preferably, the second pivot bracket is formed of steel.

Figure 19:
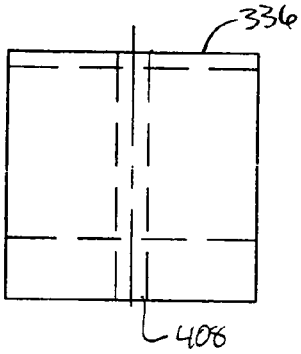
FIG. 19 is a front elevational view of a support member in accordance with an embodiment of the invention.
Figure 20:
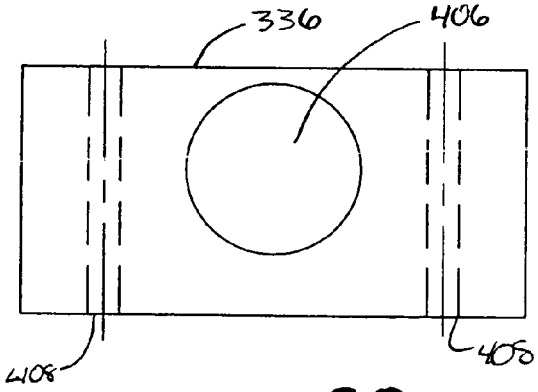
FIG. 20 is a right side elevational view of the support member shown in FIG. 19.

FIGS. 19-20 illustrate a support bracket 336. The support bracket 336 is a generally rectangular block with a hole 406 for receiving the support shaft 334. Two holes 408 allow the support bracket 336 to be fastened to the underside of the deck tubes 326 with bolts or any other suitable fasteners. Preferably, the support brackets 336 are formed of an acetal resin, such as DELRIN® from EI DuPont de Nemours Co., Inc.

Figure 22:
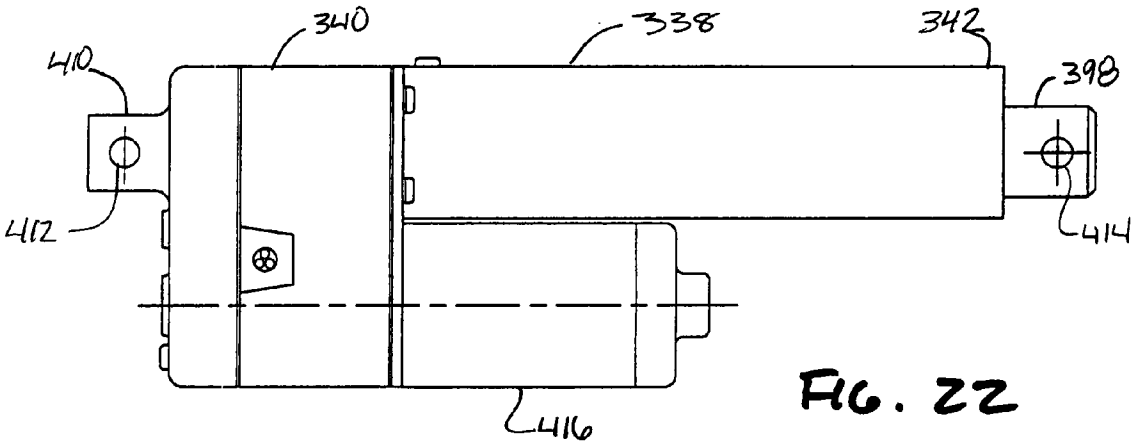
FIG. 22 is a front elevational view of the actuator shown in FIG. 21.
Figure 21:
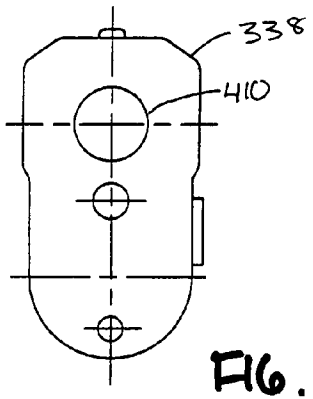
FIG. 21 is a left side elevational view of an actuator in accordance with an embodiment of the invention.

FIGS. 21 and 22 illustrate a linear actuator 338. The linear actuator 338 has a first end 340 and a second end 342. The first end 340 of the actuator 338 has a mounting portion 410, which is cylindrically shaped and has a hole 412 to receive the pivot pin 370 associated with the first pivot bracket 344. The first end 340 can pivot with respect to the first pivot bracket 344. The second end 342 of the actuator 338 has an actuator shaft 398, which is cylindrical and sized to fit into the first end 394 of the second pivot bracket 352. A hole 414 in the actuator shaft 398 receives a fastener to attach the second pivot bracket 354 to the actuator shaft 398. The actuator shaft 398 is powered by a motor 416 so that it may be extended and retracted. Preferably, the linear actuator is powered by 24 volts DC, and the actuator has a travel of least 2 inches. Preferably, the linear actuator has a built in feedback potentiometer. One suitable linear actuator is Model No. SP24-17A8-02, available from Danaher Motion in Marengo, Ill.

Figure 23:
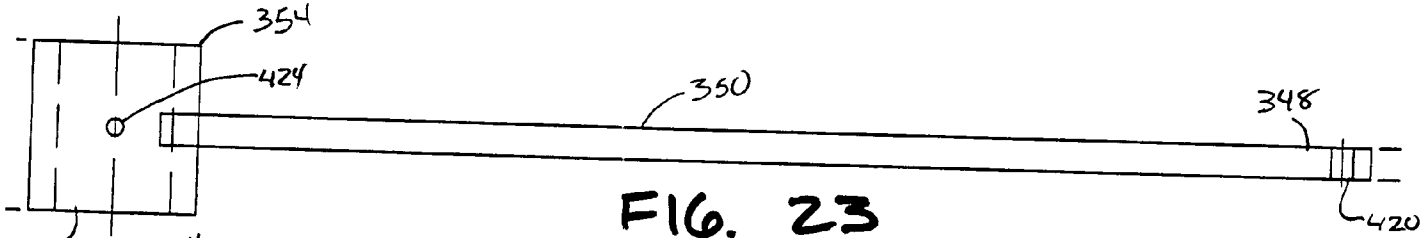
FIG. 23 is a top plan view of an operating arm in accordance with an embodiment of the invention.
Figure 24:
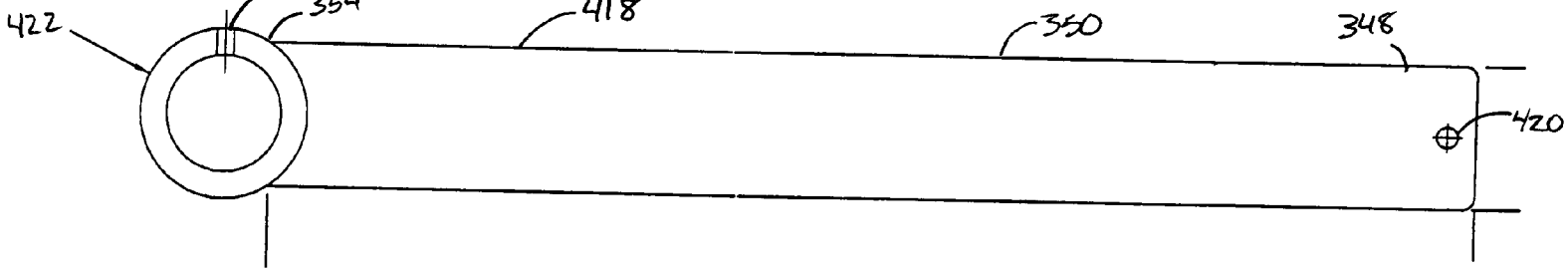
FIG. 24 is a front elevational view of the operating arm shown in FIG. 23.

FIGS. 23 and 24 illustrate the lever arm 350. The lever arm 350 has a generally rectangular arm portion 418, and has a first end 348 and a second end 354. The first end 348 of the lever arm 350 fits into the second pivot bracket 352. A pivot pin 404 (FIG. 8) passes through holes 400 in the second pivot bracket 352 and a hole 420 in the first end 348 of the lever arm 350 so that the lever arm 350 may pivot with respect to the second pivot bracket 352. The second end 354 of the lever arm 350 is attached to a cylindrical ring 422 which is sized to fit around the support shaft 334. A threaded hole 424 receives a set screw (not illustrated) so that the position of the lever arm 350 may be fixed with respect to the support shaft 334.

Figure 25:
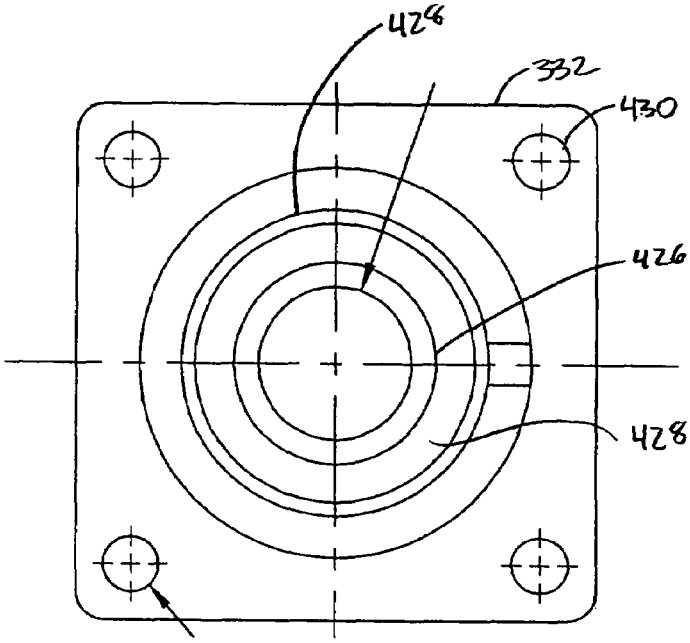
FIG. 25 is a front elevational view of a bearing in accordance with an embodiment of the invention.
Figure 26:
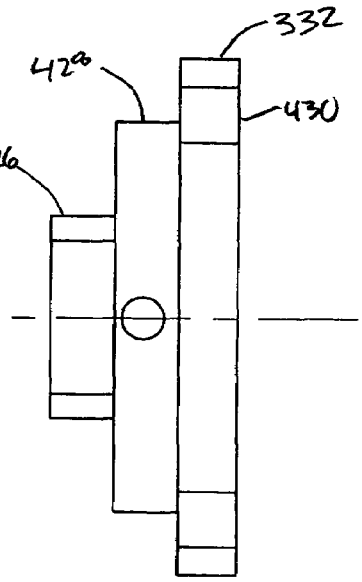
FIG. 26 is a right side elevational view of the bearing shown in FIG. 25.

FIGS. 25 and 26 illustrate the bearing 332 for supporting the end of the support shaft 334. The bearing 332 has a shaft support cylinder 426 and a shaft restraining member 428 which is concentrically disposed around the shaft support cylinder 426 to form a shaft seat 428. The support shaft 334 is seated in the shaft seat 428. The support shaft 334 may rotate with respect to the bearing 332. Four holes 430 located in the bearing 332 allow the bearing to be fastened to a frame member with bolts or other suitable fasteners. One bearing is provided to support each end of the support shaft 334. Of course, any suitable bearing known to those skilled in the art may be used.

Figure 28:
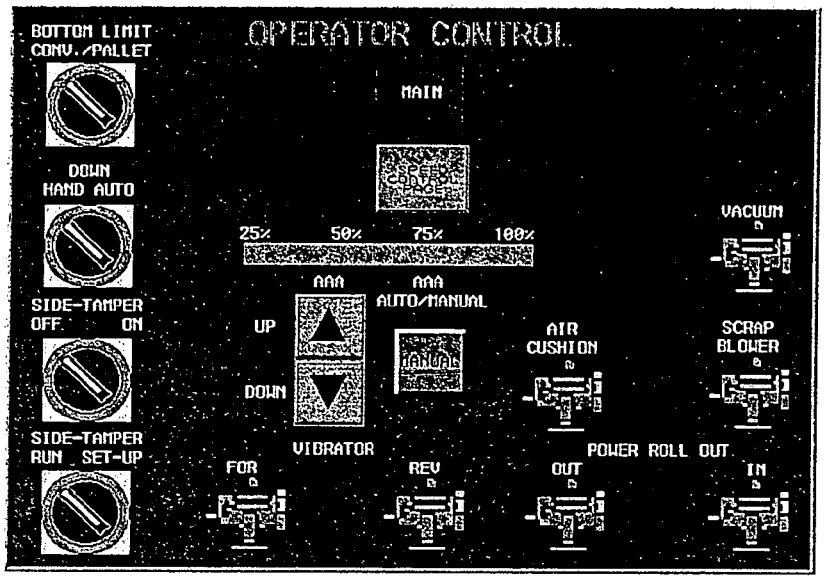
FIGS. 27 and 28 illustrate a touchscreen for use with the PLC.
Figure 27:
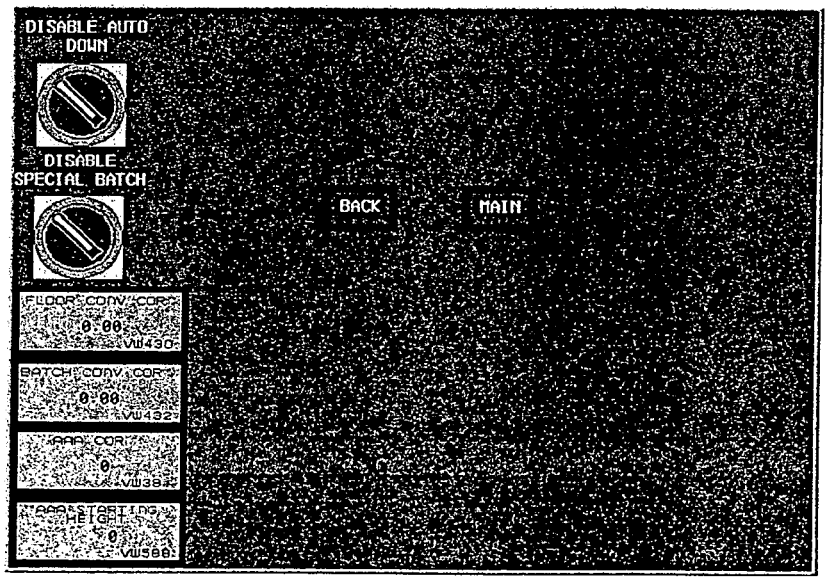

The PLC 314 preferably includes a touch screen to control the operation of the stacking apparatus, including the operation of the diverting apparatus. As seen in FIGS. 27 and 28, the touch screen includes icons to disable to set parameters relating to the diverting apparatus, which is also referred to as Auto Angle Adjust (AAA). The parameters include such values as Auto Angle Adjust Correction Value (indicated by the icon AAA COR) and Auto Angle Adjust Starting Height (indicated by the icon AAA Starting Height). Additional icons allow a user to manually raise and lower the diverting slats (i.e. AAA up and AAA down).

The PLC controls the diverting apparatus 306 by sending signals to a pair of relays (not illustrated). Preferably, one relay causes the actuator to extend, while another relay causes the actuator to retract. Further details of the operation and construction of the PLC are explained below.

Operation of the Exemplary Embodiment

In operation, the layboy section 300 receives corrugated blanks, such as those produced by a rotary die cut machine, and discharges the corrugated blanks onto the transfer conveyor 302. The transfer conveyor 302 receives the blanks and transports them to the main conveyor 304. The main conveyor 304 receives the blanks, transports the blanks along the length of the conveyor 304, and discharges the sheets at its discharge end 318 into the accumulator section 308. The accumulator section 308 receives the discharged blanks.

During the initial formation of a stack of sheets, the main conveyor 304 is pivoted to lower the discharge end 318 of the conveyor to a lower position. In the lower position, the conveyor has an angle $\theta_{a(min)}$ with respect to horizontal (FIG. 5). Sheets are discharged with sufficient momentum to strike a backstop that stops the forward momentum of the sheets. The stopped sheets settle down to form a stack of sheets. When the conveyor is at the lower position, if the sheets are discharged at the same angle $\theta_a$ as the main conveyor, the sheets do not have any upward momentum and, therefore, they may have a tendency to interlock and jam in the accumulator. To prevent this, the linear actuator 338 is actuated to raise the diverting slats 310. Preferably, the linear actuator shaft is extended so that the diverting slats 310 are raised to a preset, adjustable angle. With the diverting slats raised in this manner, sheets are diverted by the diverting slats so that the trajectory of the discharged sheets is adjusted to help minimize or eliminate interlock jamming in the accumulator.

As additional sheets are placed on the stack, the main conveyor is pivoted to raise the discharge end vertically so that the discharged sheets are stacked one by one. As the conveyor is raised, the angle of discharge of the main conveyor changes so that there is more upward momentum on the discharged sheets, even without the diverting slats. Accordingly, the diverting slats are needed less as the main conveyor is pivoted upward. Thus, as the main conveyor is raised, the linear actuator is retracted so that the angle $\theta_b$ of the diverting slats is decreased with respect to the main conveyor.

Figure 29:
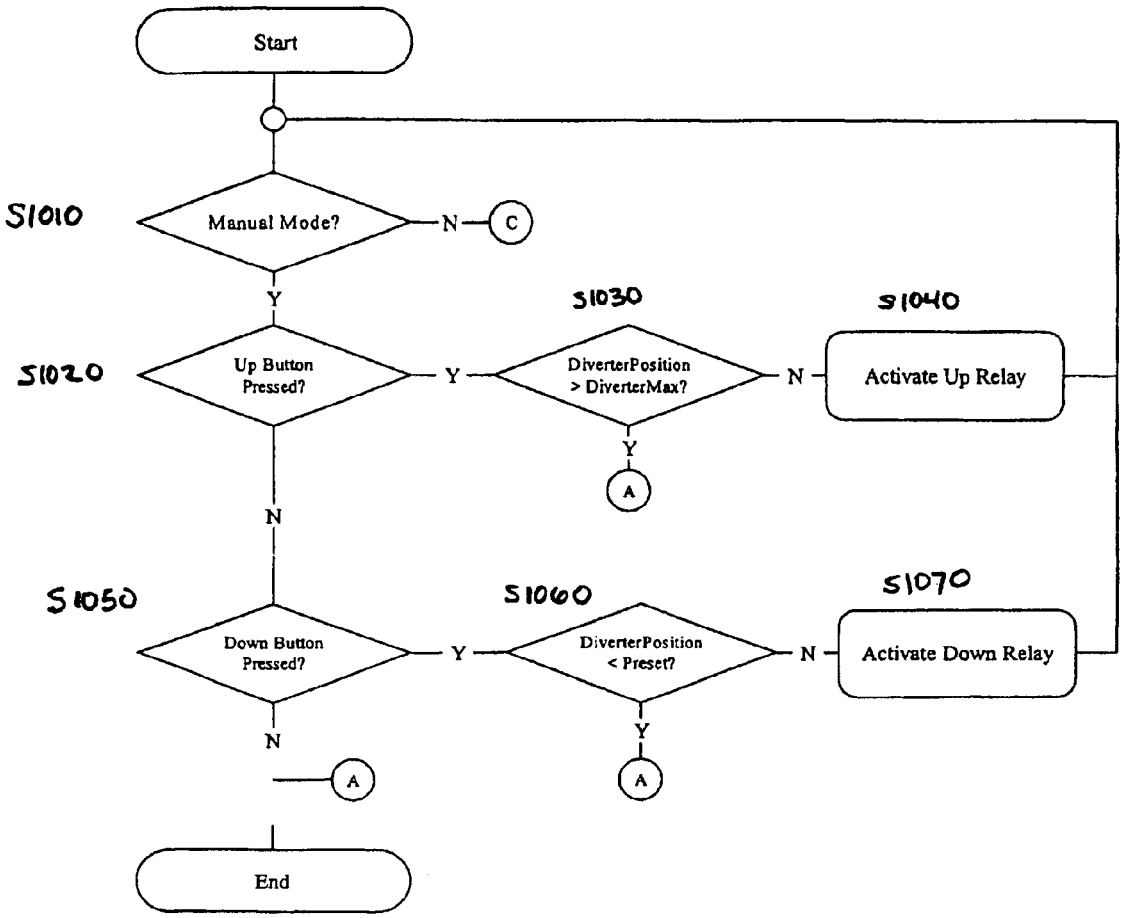
FIGS. 29-30 are flowcharts illustrating the method of using the present invention.
Figure 30:
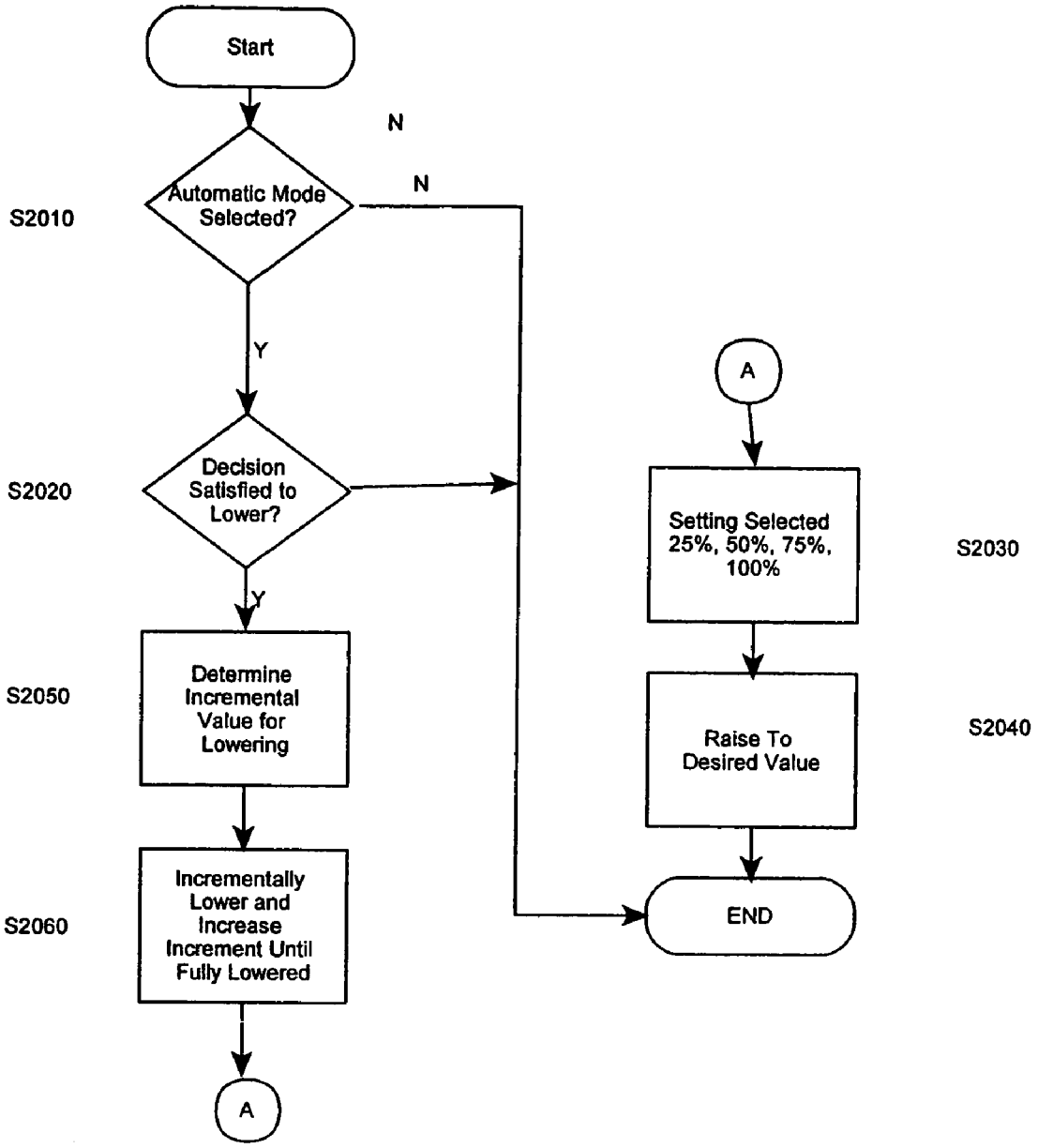

The control processes are shown in more detail in FIGS. 29 and 30. To explain the processes shown there, the variables used in those processes will first be defined. The variable StackerDeckPosition represents the position of the main conveyer. Preferably, when the main conveyor is at its highest position (that is, $\theta_{a(max)}$), the variable StackerDeckPosition is slightly below the maximum allowable value of the PLC. For example, in the following discussion, it will be assumed that the PLC is a 16 bit PLC, and therefore, the maximum allowable value is 32,767. (Of course, in the following discussion, the values are all merely exemplary, and any suitable values can be used). Thus, StackerDeckPosition is configured so that it is a value such as 32,640 when the main conveyer is at $\theta_{a(max)}$. The variable StackerDeckPosition is set near the minimum, i.e. zero, when the main conveyor is at $\theta_{a(min)}$.

The variable DiverterPosition represents the position of the diverting slats, and is derived from the feedback sent by the actuator. Preferably, when the diverting slats are fully raised, (that is, $\theta_b=\theta_{b(max)}$), the value of DiverterPosition is approximately 19,400. When the diverting slats are fully retracted (i.e. $\theta_b=0$), the value is approximately 450.

A variable StackerLowerLimit represents the lower limit of the stacking device in operation. Preferably, the variable StackerLowerLimit is set by entering an inch value on the PLC touchscreen. The PLC converts the inch value into a numeric value that corresponds to the StackerDeckPosition variable at that position. For example, in a typical application, the lower limit of the main conveyor is approximately 1" above a discharge conveyor that receives discharged sheets. (This is approximately 12-18" off of the ground.) At that height, the value of StackerDeckPosition is approximately 7,200, so the value StackerLowerLimit is set to 7,200.

A variable DivertStartingPosition is also set by a user using the touchscreen on the PLC. DivertStartingPosition represents the position of the conveyor where the diverting slats are initially activated. In other words, when the angle $\theta_a$ of the main conveyor is above the DivertStartingPosition, the diverting slats are fully retracted (i.e. $\theta_b=0$). Below DivertStartingPosition, the diverting slats are raised by an amount that will be discussed in detail below. Preferably, DivertStartingPosition is set to correspond to an angle $\theta_a$ that is slightly above level. Using a 16 bit PLC, this value corresponds to approximately 21,000. Of course, this value can be set by the user to any desired number.

A variable DivertPercent is set by the user. The variable DivertPercent allows a user to choose whether the diverting slats will be used to the maximum extent possible or if the slats will be used to a lesser extent. Preferably, the Divert Percent lift value has five options that a user may choose and each option sets the variable to a different value, as shown in Table 1. As will be explained in detail below, the DivertPercent variable limits the maximum height of the diverting slats. Preferably, the value of DivertPercent is set by using the up and down arrows on the PLC touchscreen, and a bar on the PLC screen shows the DivertPercent setting. Preferably, the default setting is 100%.

TABLE 1

| Percent | Value |
|---|---|
| <25% | 11700 |
| 25% | 13650 |
| 50% | 15600 |
| 75% | 17550 |
| 100% | 19400 |

A variable DiverterMax represent the maximum extension of the diverting flaps. The variable DiverterMax is user adjustable, but preferably, the variable is not readily accessible to a user (i.e. it is only accessible in maintenance mode). In the exemplary embodiment disclosed herein, when the diverting slats are fully raised, (that is, $\theta_b=\theta_{b(max)}$), the value of DiverterMax is approximately 19,400.

A variable DivertCorrectValue is set by a user, and a variable BitIncrement is set to 1 when the diverting slats are fully retracted. The purpose of these variables will be discussed in detail below.

Referring to FIG. 29, the first step in the operation of the diverting apparatus is to check whether the manual mode is selected (S1010). In manual mode, the PLC checks whether the up button is pressed (S1020). If the up button is pressed, the PLC then checks whether the value of DiverterPosition is greater than DiverterMax (S1030). If so, the diverting slats are at the preset maximum value, and no action is taken. If not, the PLC activates the relay that causes the linear actuator to extend, thereby causing the diverting slats to raise (S1040). The process is repeated so long as the up button is pressed. Similarly, if the down button is pressed (S1050), the PLC checks whether the value of DiverterPosition is less than a preset value (e.g., 450) (S1060). If so, the diverting slats are fully retracted, and no action is taken. If not, the PLC activates the relay that causes the linear actuator to retract, thereby causing the diverting slats to lower (S1070).

In automatic mode, the process for controlling the diverting slats differs depending on whether the main conveyor is rising or lowering. FIG. 30 shows the process as the diverting slats rise based on four settings, and as the diverting slats are lowered in increments.

Referring to FIG. 30, the first step in the operation of the diverting apparatus is to check whether the automatic mode is selected at (S2010). Once automatic mode is determined, the operation then determines if the diverting slats are to be raised or lowered at (S2020). The diverting slats will lower in a down cycle until an increment counter reaches a value indicating that that the diverting slats are fully lowered, at which point, the increment counter is reset.

If in automatic mode and with the diverting slats down, the diverting slats are automatically raised until reaching a desired height. The desired height can be based upon a position analog value, a percentage height setting value, and an actuator feedback value. For example, if the diverting slats are to be raised, the operator is given a choice of five settings of <25%, 25%, 50%, 75%, and 100% at (S2030), wherein 100% is the preset upper limit, or DiverterMax. Accordingly, at (S2040), the diverting slats are raised to the desired value.

If in automatic mode and with the diverting slats not already down, the diverting slats can be automatically lowered until reaching a desired height. The desired height can be based upon a position analog value, and an actuator feedback value. For example, if the determination is made at (S2020) to lower the diverting slats, the PLC will first determine the incremental value that the diverting slats will be lowered at (S2050). In automatic mode, the diverting slats will lower as the main conveyor rises. To achieve this, the PLC takes the upper limit, or DiverterMax, of the diverting slats and subtracts the lower limit, or StackerLowerLimit. The result is divided by a correction value, or DivertCorrectValue, and then multiplied by a variable and added to the main conveyor height to determine an incremental amount that the diverting slats are lowered at (S2060).

Thus, by using the present invention, the trajectory of the sheets discharged by a stacking apparatus is maintained at a steady angle, thereby helping to eliminate interlock jamming in the accumulator.

While the invention has been shown and described with reference to certain embodiments thereof, it will be understood by those skilled in the art that various changes in form and details may be made therein without departing from the spirit and scope of the invention as defined by the appended claims.

What is claimed is:

1. A rotary die cut stacker for stacking sheets, comprising:

a layboy section for receiving sheets from a rotary die cut machine and for aligning the sheets;

a base;

a first frame member pivotably mounted to the base;

a conveyor, pivotably mounted to the first frame member, for receiving the sheets at an intake end, transporting the sheets, and discharging the sheets from a discharge end, the intake and discharge ends being non-rotatively fixed with respect to each other, the conveyor forming an acute angle $\theta_a$ with respect to horizontal, wherein the conveyor comprises a plurality of belts, each of the plurality of belts extending from the intake end to the discharge end such that a space is formed between each of the plurality of belts; and a plurality of pivotable slats located between the intake and discharge ends of the conveyor for adjusting the angle of discharge of discharged sheets, the plurality of pivotable slats pivoting about a horizontal axis to form an acute angle $\theta_b$ with respect to the top of the conveyer, wherein the angles $\theta_a$ and $\theta_b$ are inversely proportional so that as the angle $\theta_a$ is increased, the angle $\theta_b$ is decreased, wherein each of the plurality of pivotable slats includes a first lateral end and a second lateral end such that the first lateral end is a further distance from the intake end of the conveyor than is the second lateral end and such that the first lateral end of each slat is closer to the intake end of the conveyor than the discharge end of the conveyor is to the intake end of the conveyor and further wherein the plurality of pivotable slats is configured in an alternative manner with the plurality of belts such that each of the pivotable slats is respectively located in a space between each of the plurality of belts.

2. The rotary die cut stacker for stacking sheets according to claim 1, further comprising:

a linear actuator operatively engaged with the plurality of pivotable slats to adjust the angle of rotation of the slats.

3. The rotary die cut stacker for stacking sheets according to claim 2, wherein the linear actuator is electrically operated and electronically controlled.

4. The rotary die cut stacker for stacking sheets according to claim 2, wherein the plurality of slats are disposed on a horizontal support shaft.

5. The rotary die cut stacker for stacking sheets according to claim 4, further comprising:

an arm to connect the linear actuator to the horizontal support shaft.

6. The rotary die cut stacker for stacking sheets according to claim 1, wherein the conveyor includes a main deck formed by a plurality of deck tubes.

7. The rotary die cut stacker for stacking sheets according to claim 6, further comprising a plurality of shaft support members disposed on the deck tubes at the discharge end of the conveyor; and a horizontal support shaft supported by the shaft support members, the horizontal support shaft supporting the plurality of pivotable slats.

8. The rotary die cut stacker for stacking sheets according to claim 1, further comprising means for electronically controlling the pivotable slats.

9. An apparatus for stacking sheets, comprising:

a conveyor frame having an intake end and a discharge end that are at non-rotatively fixed positions with respect to one another;

a conveyor disposed on the conveyor frame for receiving sheets at the intake end, transporting the sheets, and discharging the sheets from the discharge end, the conveyor forming an acute angle $\theta_a$ with respect to horizontal, wherein the conveyor comprises a plurality of belts, each of the plurality of belts extending from the intake end to the discharge end such that a space is formed between each of the plurality of belts;

a plurality of pivotable slats located entirely between the intake end and the discharge end of the conveyor at the discharge end of the conveyor for adjusting the angle of discharge of discharged sheets, wherein the plurality of pivotable slats is configured in an alternative manner with the plurality of belts such that each of the pivotable slats is respectively located in a space between each of the plurality of belts;

an actuator for controlling the plurality of pivotable slats to pivot about a horizontal axis to form an acute angle $\theta_b$ with respect to the top of the conveyor, wherein the angles $\theta_a$ and $\theta_b$ are inversely proportional so that as the angle $\theta_a$ is increased, the angle $\theta_b$ is decreased; and an accumulator for receiving sheets discharged from the discharge end of the conveyor.

10. The apparatus for stacking sheets according to claim 9, wherein the actuator comprises a linear actuator operatively engaged with the plurality of pivotable slats to adjust the angle of rotation of the slats.

11. The apparatus for stacking sheets according to claim 10, wherein the plurality of slats are disposed on a horizontal support shaft.

12. The apparatus for stacking sheets according to claim 11, further comprising an arm to connect the linear actuator to the horizontal support shaft.

13. The apparatus for stacking sheets according to claim 9, wherein the conveyor includes a main deck formed by a plurality of deck tubes.

14. The apparatus for stacking sheets according to claim 13, further comprising a plurality of shaft support members disposed on the deck tubes at the discharge end of the conveyor; and a horizontal support shaft supported by the shaft support members, the horizontal support shaft supporting the plurality of pivotable slats.

15. The apparatus for stacking sheets according to claim 9, wherein the actuator is an electrically operated and electronically controlled linear actuator.

16. An apparatus for adjusting the angle of discharge of sheets being discharged from a discharge end of a conveyor forming an acute angle $\theta_a$ with respect to horizontal in a sheet stacking device, the apparatus comprising:

shaft support members located at the discharge end of the conveyor;

a horizontal support shaft rotatably disposed in the shaft support members;

a plurality of pivotable slats, each slat having a first end and a second end, the first end of each slat being connected to the horizontal support shaft, the plurality of pivotable slats pivoting about a horizontal axis to form an acute angle $\theta_b$ with respect to the top of the conveyer, wherein the angles $\theta_a$ and $\theta_b$ are inversely proportional so that as the angle $\theta_a$ is increased, the angle $\theta_b$ is decreased, wherein the second end of each of the plurality of pivotable slats is closer to an intake end of the conveyor than the discharge end of the conveyor is to the intake end of the conveyor and further wherein each of the plurality of slats is arranged in an alternative manner with each of a plurality of belts of the conveyor; and an actuator connected to the support shaft to rotate the horizontal support shaft.

17. The apparatus according to claim 16, further comprising an actuator arm located between and operatively engaging with the actuator and the horizontal support shaft.

18. The apparatus according to claim 16, wherein each slat has an adjustable opening at the first end for receiving the horizontal support shaft.

19. The apparatus according to claim 16, wherein the actuator is an electrically operated and electronically controlled linear actuator.

20. The apparatus according to claim 16, further comprising means for electronically controlling the actuator.

21. The apparatus according to claim 20, wherein the means for electronically controlling the actuator includes a programmable logic controller with a touch-screen interface.

22. The rotary die cut stacker according to claim 1, wherein the plurality of slats directly contact the discharged sheets to adjust the angle of discharge of the discharged sheets.

23. The rotary die cut stacker according to claim 1, wherein the angle $\theta_b$ is at a maximum when the angle $\theta_a$ is at a minimum, and the angle $\theta_b$ is at a minimum when the angle $\theta_a$ is at a maximum.

24. The rotary die cut stacker according to claim 1, wherein the relation between angle $\theta_a$ and angle $\theta_b$ is adjustable.

25. The apparatus according to claim 9, wherein the plurality of slats directly contact the discharged sheets to adjust the angle of discharge of discharged sheets.

26. The apparatus according to claim 9, wherein the angle $\theta_b$ is at a maximum when the angle $\theta_a$ is at a minimum, and the angle $\theta_b$ is at a minimum when the angle $\theta_a$ is at a maximum.

27. The apparatus according to claim 9, wherein the relation between angle $\theta_a$ and angle $\theta_b$ is adjustable.

28. The apparatus according to claim 16, wherein the plurality of slats directly contact the discharged sheets to adjust the angle of discharge of discharged sheets.

29. The apparatus according to claim 16, wherein the angle $\theta_b$ is at a maximum when the angle $\theta_a$ is at a minimum, and the angle $\theta_b$ is at a minimum when the angle $\theta_a$ is at a maximum.

30. The apparatus according to claim 16, wherein the relation between angle $\theta_a$ and angle $\theta_b$ is adjustable.

* * * * *